US006526152B2

(12) United States Patent
Frasl

(10) Patent No.: US 6,526,152 B2
(45) Date of Patent: Feb. 25, 2003

(54) ELECTROACOUSTIC TRANSDUCER HAVING A MOVING COIL AND ELASTIC HOLDING ELEMENTS FOR THE CONNECTING LEADS OF THE MOVING COIL

(75) Inventor: Ewald Frasl, Biedermannsdorf (AT)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/769,181

(22) Filed: Jan. 25, 2001

(65) Prior Publication Data

US 2001/0010728 A1 Aug. 2, 2001

(30) Foreign Application Priority Data

Jan. 27, 2000 (EP) ..... 00890029

(51) Int. Cl.[7] ..... H04R 25/00

(52) U.S. Cl. ..... 381/409; 381/410; 381/394; 439/492

(58) Field of Search ..... 381/150, 386, 381/394, 409, 410, 395, 396; 439/492, 86

(56) References Cited

U.S. PATENT DOCUMENTS 2,521,513 A 9/1950 Gray
2,906,828 A * 9/1959 Carbonneau ..... 381/409
4,327,311 A 4/1982 Wroblewski
4,368,407 A 1/1983 Wroblewski
4,464,700 A 8/1984 Stenerhag et al.
4,922,156 A 5/1990 Turcotte et al.
5,057,967 A 10/1991 Den et al.
5,091,958 A * 2/1992 Sakamoto et al. ..... 381/150
5,359,487 A 10/1994 Carrico et al.
5,670,864 A 9/1997 Marx et al.
6,038,327 A * 3/2000 Bleim et al. ..... 381/386
6,072,886 A * 6/2000 Frasl et al. ..... 381/409

* cited by examiner

*Primary Examiner*—Huyen Le
(74) *Attorney, Agent, or Firm*—Steven R. Biren

(57) ABSTRACT

In an electroacoustic transducer (1) having a magnet system (8) and having a diaphragm holder (2) for holding a diaphragm (17) and having a moving coil (115) connected to the diaphragm (17), the moving coil (15) has a hollow cylindrical coil body (27) and two connecting leads (28, 29), a holding element (38, 39) connected to the diaphragm holder (2) being provided for each connecting lead (28, 29), which holding elements (38, 39) are constructed to be elastically deformable in a direction substantially parallel to the diaphragm axis (26) and, preferably, also to be mechanically damping.

2 Claims, 1 Drawing Sheet

ELECTROACOUSTIC TRANSDUCER HAVING A MOVING COIL AND ELASTIC HOLDING ELEMENTS FOR THE CONNECTING LEADS OF THE MOVING COIL

BACKGROUND OF THE INVENTION

The invention relates to an electroacoustic transducer as defined in the opening part of claim 1.

Such an electroacoustic transducer of the type defined in the opening part of claim 1 is commercially available from the applicant in many versions and is consequently known. In the known transducer the connecting leads are led from the coil body of the moving coil directly to stationary terminal contacts of the transducer without any further ancillary means and are consequently held at a distance from the diaphragm of the known transducer merely by virtue of their own stiffness. In order to enable a maximal excursion, i.e. a maximal vibration amplitude, of the diaphragm to be obtained with such a transducer the connecting leads should have a comparatively great length. However, this entails the problem that such connecting leads of a comparatively great length have a comparatively strong tendency to vibrate, as a result of which under unfavorable conditions the comparatively long connecting leads may be set into vibration, which vibrations may have a conical low frequency and a comparatively high amplitude owing to the comparatively great length of the connecting leads. Such vibrations lead to undesired noises as well as to a relatively high mechanical loads on the connections of the free ends of the connecting leads to the stationary terminal contacts of the transducer. This comparatively high mechanical load may lead to breakage of the connecting leads of the moving coil in the area near the stationary terminal contacts of the transducer, which results in unserviceableness of the transducer and is therefore undesirable.

SUMMARY OF THE INVENTION

It is an object of the invention to preclude the aforementioned problems and to provide an improved electroacoustic transducer in which undesired vibrational movements of the connecting leads of a moving coil are avoided.

According to the invention the characteristic features defined in the characterizing part of claim 1 are provided in an electroacoustic transducer as defined in the opening part of claim 1.

By providing the characteristic features in accordance with the invention it is achieved in a simple manner that the connecting leads of the moving coil are held by means of the holding elements and, as a result of the elasticity of the holding elements, are hardly restrained in their movability in a direction parallel to the diaphragm axis but that, as a result of the connection of the connecting leads to the elastic holding elements, the generation of vibrations of comparatively low frequency and comparatively high amplitude is precluded and, as a consequence, only vibrations of comparatively high frequency can occur which have only comparatively low amplitudes, as a result of which the connecting leads are not subjected to excessive mechanical loads in the area where their free ends are connected to stationary terminal contacts of a transducer in accordance with the invention. Thus, it is guaranteed that, even after a long period of use of a transducer in accordance with the invention, no breakage of the connecting leads occurs in the areas of the free ends of the connecting leads, as a result of which unserviceableness of such a transducer due to breakage of its connecting leads is effectively precluded.

It has proved to be particularly advantageous when a transducer in accordance with the invention, in addition, has the characteristic feature defined in claim 1. In this way, it is achieved that in addition a mechanical damping effect is obtained with the aid of the holding elements, which provides a mechanical damping of any vibrations of comparatively high frequency which might possibly occur, which guarantees a particularly good protection against possible breakage of the free ends of the connecting leads.

Further advantageous embodiments of a transducer in accordance with the invention have the characteristic features defined in claim 1 or 2. The provision of these characteristic features has the advantage that a simple construction is obtained, which can also be realized simply.

The above-mentioned as well as further aspects of the invention will become apparent from the embodiment described hereinafter by way of example and will be elucidated with reference to this example.

BRIEF DESCRIPTION OF THE DRAWING

The invention will now be described in more detail with reference to the drawing, which shows an embodiment given by way of example but to which the invention is not limited.

DESCRIPTION OF THE PREFERRED EMBODIMENTS

Figure 1:
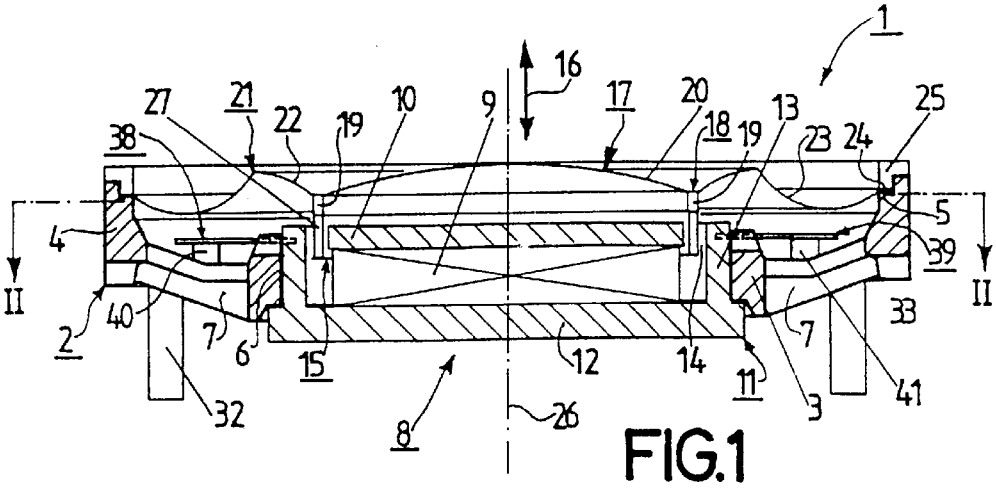
FIG. 1 is a partly diagrammatic cross-sectional view to a scale larger than full scale, which shows an electroacoustic transducer in accordance with an embodiment of the invention.
Figure 2:
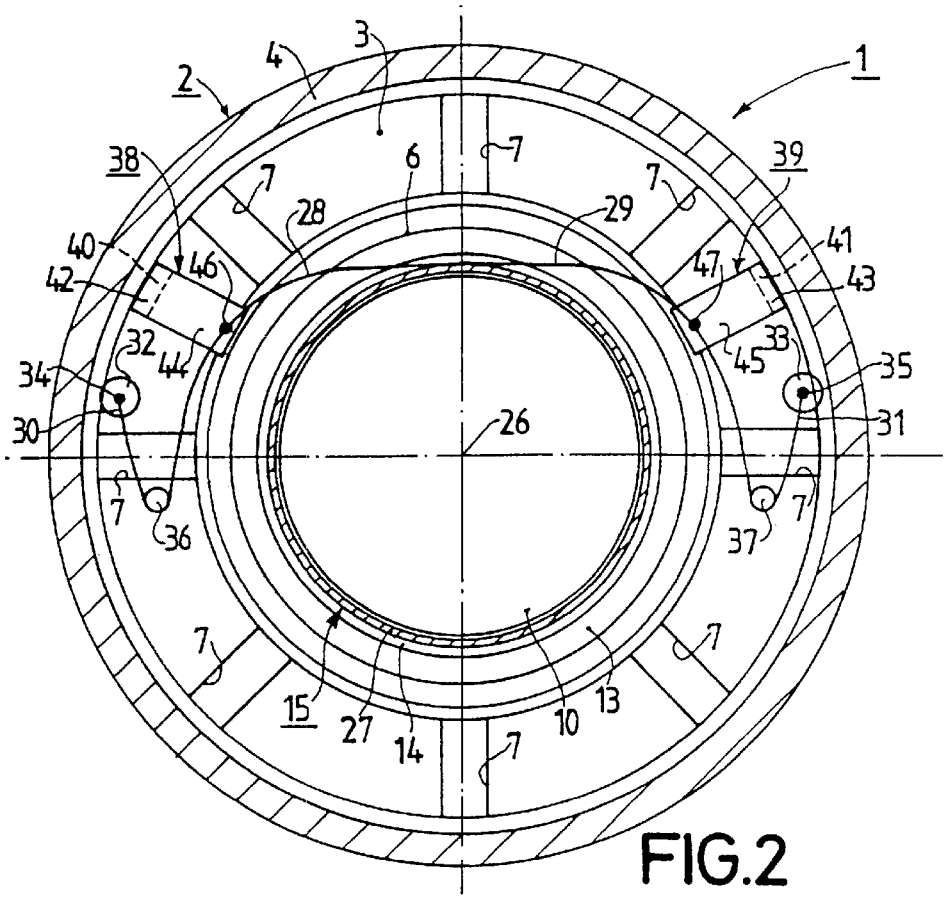
FIG. 2 shows the transducer of FIG. 1 in a sectional view taken on the line II—II in FIG. 1.

FIGS. 1 and 2 show an electroacoustic transducer 1, hereinafter briefly referred to as the transducer 1. The transducer 1 has a substantially pot-shaped housing 2, which comprises a housing bottom 3, and a hollow cylindrical housing wall 4, which has a stepped portion 5 at its side which is remote from the housing bottom 3. The housing bottom 3 has a circularly cylindrical passage 6. The housing bottom 3 further has a total of eight (8) slots 7.

The transducer 1 has a magnet system 8. The magnet system 8 consists of a magnet 9, a pole plate 10 and a pot 11, which is often also referred to as the outer pot and which consists of a pot bottom 12, and a hollow cylindrical pot portion 13. The hollow cylindrical pot portion 13 is accommodated in the passage 6 in the housing bottom 3, a mechanically and acoustically sealed connection being provided between the housing bottom 3 and the pot 111, which connection is formed by a press-fit but which may alternatively be formed by, for example, an adhesive joint.

Between the circumferential bounding surface of the pole plate 9 and the end portion of the hollow cylindrical pot portion 13, which end portion faces the pole plate 9, an air gap 14 is formed. A moving coil 15 of the transducer 1 is disposed partly in the air gap 14. By means of the magnet system 8 the moving coil 15 can be set into vibration in a direction substantially parallel to a direction of vibration, indicated by a double arrow 16 in FIG. 1. The moving coil 15 is connected to a diaphragm 17 of the transducer 1. The diaphragm 17 is not shown in FIG. 2.

To attach the moving coil 15 to the diaphragm 17 the diaphragm 17 has a plurality of projections 19 in an annular mounting zone 18, which projections are spaced apart equiangularly and project from the diaphragm 17 towards the magnet system 8. The moving coil 15 is attached to the projections 19 by means of adhesive joints. In addition to the annular mounting zone 18, the diaphragm 17 has an inner zone 2, which is convex with respect to the acoustic free space and is situated within the mounting zone 18, as well as an outer zone 21, which is situated outside the mounting zone 18. In the present case the outer zone 21 consists of a first outer zone portion 22, which is convex with respect to the acoustic free space and which adjoins the mounting zone 18, and a second outer zone portion 23, which is concave with respect to the acoustic free zone and which adjoins the first outer zone portion 22. The second outer zone portion 23 adjoins an annular plane peripheral zone 24.

The diaphragm 17 is attached to the housing 2 of the transducer 1 by the peripheral zone 24 in the area of the stepped portion 5, namely with the aid of an adhesive joint. For securing the peripheral zone 24 of the diaphragm 17 to the housing 2 the transducer 1 further has a mounting ring 25. Thus, in the transducer 1 the diaphragm 17 is mounted with the aid of the housing 2, as a result of which the housing 2 at the same time constitutes a diaphragm holder.

The diaphragm 17 is constructed so as to be capable of vibrating in a direction parallel to a diaphragm axis 26, which also forms a transducer axis of the transducer 1. To set the diaphragm 17 into vibration the moving coil 15, as already stated, is attached to the diaphragm 17.

The moving coil 15, which is adapted to cooperate with the magnet system 8, has a hollow cylindrical coil body 27 wound from a coil wire. The moving coil 15 further has two connecting leads 28 and 29, which are shown in FIG. 2 but not in FIG. 1. The two connecting leads 28 and 29 are formed by the end portions of the coil wire of which the moving coil 15 is made. Each of the two connecting leads 28 and 29 has its respective free end 30 or 31 connected to a stationary terminal contact 32 or 33, respectively. The two terminal contacts 32 and 33 are each formed by a contact pin mounted in the housing 2. However, the two terminal contacts 32 and 33 may alternatively be formed by wire-shaped or blade-shape spring contacts. The connections of the two free ends 30 and 31 to the stationary terminal contacts 32 and 33, respectively, are both of an electrical and a mechanic nature, the connections being formed by soldered joints 34 and 35.

As is apparent from FIG. 2, the connecting leads 28 and 29 are led around a guide pin 36 or 37 in their areas near the two terminal contacts 32 and 33. The two guide pins 36 and 37 have the advantage that the vibrations transmitted to the connecting leads 28 and 29 while the moving coil 15 vibrates cannot directly act upon the soldered joints 34 and 35.

Advantageously, a holding element 38 or 39 is provided for each of the connecting leads 28 and 29 of the moving coil 15 in the transducer 1. Each of the two holding elements 38 and 39 is connected to a stationary part of the transducer 1, in the present case to the housing 2 of the transducer 1, for which purpose the housing 2 has two mounting projections 40 and 41. In the present case, the two holding elements 38 and 39 are plateshaped an have a mounting portion 42, 43 to be secured to the mounting projections 40 and 41 and a holding portion 44, 45, which projects from the mounting portion 42, 43 towards the transducer axis 26 and has its free end connected to the respective connecting lead 28 or 29. The connections between the holding portions 44 and 45 and the connecting leads 28 and 29 are formed by two adhesive joints 46 and 47.

Figure 3:
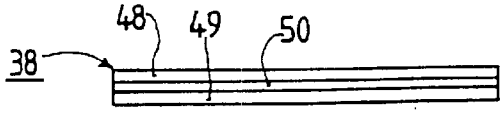
FIG. 3 is a diagrammatic side view of a holding element of the transducer shown in FIGS. 1 and 2.

The two holding elements 38 and 39 are elastically deformable in directions substantially parallel to the diaphragm axis 26. In addition, the two holding elements 38 and 39 are constructed to provide mechanical damping. In order to achieve this, it has proved to be particularly advantageous if each of the two holding elements 38 and 39, as is shown diagrammatically for the holding element 38 in FIG. 3, consists of two plastic foils 48 and 49 and an adhesive layer 50 interposed between the two plastic foils 48 and 49. The two plastic foils 48 and 49 are preferably polycarbonate foils. The adhesive layer 50 consists of a so called non-curing adhesive, which consequently retains its flexibility over a long lifetime and guarantees the mechanical damping action of the holding elements 38 and 39.

It is to be noted that it is also possible to provide two or more of such holding elements 38, 39 for each connecting lead 28 or 29. However, the holding elements 38 and 39 may alternatively be formed by resilient strips which project from the housing 2, if the housing 2 is made of a material suited for this purpose.

As a result of the provision of the two holding elements 38 and 39 in the transducer 1 described hereinbefore it is achieved in a simple manner that by the connection of the connecting leads 28 and 29 to the holding elements 38 and 39 the generation of vibration modes of the connecting leads 28 and 29 with a comparatively low frequency and comparatively high amplitude is precluded and, in addition, any vibration modes of the connecting leads 28 and 29 with a comparatively high frequency that should arise are mechanically damped to such a degree that altogether a good protection for the connecting leads 28 and 29 and for the joints 34 and 35 of the connecting leads 28 and 29 to the terminal contacts 32 and 33 is achieved and an undesired contact of the connecting leads 28 and 29 with the diaphragm 17 is precluded.

What is claimed is:

1. An electroacoustic transducer having stationary parts, of which one part is formed by a diaphragm holder for holding a diaphragm, and having a magnet system, and having a diaphragm which is constructed to be capable of vibrating in a direction parallel to a diaphragm axis and which has a peripheral zone connected to the diaphragm holder, and having a moving coil adapted to cooperate with the magnet system and having a hollow cylindrical coil body and two connecting leads, which connecting leads each have a free end electrically and mechanically connected to a stationary terminal contact of the transducer, wherein at least one of the two conducting leads is secured by at least one guide pin, wherein at least one holding element is provided for each connecting lead of the moving coil, and each holding element is connected to a stationary part of the transducer, and each holding element is constructed so as to be elastically deformable in a direction substantially parallel to the diaphragm axis, and each connecting lead is connected to each holding element, and wherein each holding element is of a mechanically damping construction, each holding element is substantially plate-shaped and has a mounting portion to be secured to a stationary part of the transducer and a holding portion which projects from the mounting portion and to whose free end the connecting lead is connected, and each holding element consists of two plastic foils held together by means of an adhesive layer of a non-curing adhesive.

2. An electroacoustic transducer as claimed in claim 1, wherein only one holding element is provided for each connecting lead.

* * * * *